US007913616B2

(12) United States Patent
Aoki et al.

(10) Patent No.: US 7,913,616 B2
(45) Date of Patent: Mar. 29, 2011

(54) RAM POSITION DETECTION METHOD, RAM DRIVE METHOD, RAM DRIVE DEVICE, AND PRESS MACHINE HAVING THE RAM DRIVE DEVICE

(75) Inventors: Makoto Aoki, Isehara (JP); Hiroyuki Mizushima, Isehara (JP); Nobuaki Ariji, Isehara (JP); Shigeki Noguchi, Isehara (JP)

(73) Assignee: Amada Company, Limited, Kanagawa (JP)

( * ) Notice: Subject to any disclaimer, the term of this patent is extended or adjusted under 35 U.S.C. 154(b) by 450 days.

(21) Appl. No.: 11/915,798

(22) PCT Filed: Jun. 1, 2006

(86) PCT No.: PCT/JP2006/310970

§ 371 (c)(1),
(2), (4) Date: Feb. 27, 2008

(87) PCT Pub. No.: WO2006/129746

PCT Pub. Date: Dec. 7, 2006

(65) Prior Publication Data

US 2009/0025577 A1 Jan. 29, 2009

(30) Foreign Application Priority Data

| | | |
|---|---|---|
| Jun. 2, 2005 | (JP) | 2005-162687 |
| Nov. 22, 2005 | (JP) | 2005-337717 |
| May 1, 2006 | (JP) | 2006-127475 |
| May 1, 2006 | (JP) | 2006-127477 |

(51) Int. Cl.
*B30B 13/00* (2006.01)
*B30B 1/32* (2006.01)

(52) U.S. Cl. ..... 100/35; 100/49; 100/271; 100/269.14; 100/269.18

(58) Field of Classification Search ..... 100/35, 100/269.01, 271, 269.05, 269.08, 269.14, 100/269.18, 43, 49; 72/453.01, 453.04, 453.06, 454; 60/413, 419
See application file for complete search history.

(56) References Cited

U.S. PATENT DOCUMENTS 5,735,201 A * 4/1998 Hirao et al. ..... 100/269.01

(Continued)

FOREIGN PATENT DOCUMENTS

| | | |
|---|---|---|
| JP | 10-141313 | 5/1998 |
| JP | 11-291097 | 10/1999 |
| JP | 2002-295624 | 10/2002 |

OTHER PUBLICATIONS

English Language Abstract of JP 2002-295624.
English Language Abstract of JP 10-141313.

(Continued)

*Primary Examiner* — Jimmy T Nguyen
(74) *Attorney, Agent, or Firm* — Greenblum & Bernstein P.L.C.

(57) ABSTRACT

A ram driving method including the steps of fixing one end of a large-diameter piston rod integral with a large-diameter piston reciprocably included in a large-diameter cylinder attached integrally to a ram to a fixing unit, connecting one end of a small-diameter piston rod integral with a small-diameter piston reciprocably included in a small-diameter cylinder integral with the large-diameter cylinder to a moving member moved by a motor driving, integrally moving the small-diameter cylinder and the small-diameter piston and communicating a first compartment and a second compartment of the large-diameter cylinder divided by the large-diameter piston with each other, moving the ram integrally with the small-diameter piston rod moved by the moving member, and communicating the small-diameter cylinder with the large-diameter cylinder, thereby moving the large-diameter cylinder with a strong force by a working fluid supplied from the small-diameter cylinder.

9 Claims, 5 Drawing Sheets

U.S. PATENT DOCUMENTS

| | | | | |
|---|---|---|---|---|
| 6,941,783 | B2 * | 9/2005 | Yamanaka et al. | 72/17.2 |
| 2005/0126358 | A1 | 6/2005 | Yamamoto | |
| 2007/0150083 | A1 | 6/2007 | Kanazawa et al. | |

OTHER PUBLICATIONS

English Language Abstract of JP 11-291097.

* cited by examiner

PRIOR ART

RAM POSITION DETECTION METHOD, RAM DRIVE METHOD, RAM DRIVE DEVICE, AND PRESS MACHINE HAVING THE RAM DRIVE DEVICE

CROSS REFERENCE TO RELATED APPLICATION

The present application is a National Stage of International Application PCT/JP2006/310970, filed on Jun. 1, 2006.

TECHNICAL FIELD

The present invention relates to a ram position detection method, a ram driving apparatus, and a press machine including the ram driving apparatus for a press machine (pressurizer) including a reciprocable ram, such as a press brake. More specifically, the present invention relates to a ram position detection method, a ram driving method, a ram driving apparatus, and a press machine including the ram driving apparatus capable of moving the ram at high velocity using a mechanical configuration and pressing a target by fluid pressure at low velocity at high pressing force when the ram performs a pressurization operation.

BACKGROUND ART

As a configuration for driving a ram (slider) movable by a fluid pressure machine, a configuration for reciprocally driving a ram, a table or the like that is one example of a slide is adopted in a press machine (pressurizer) of various types, and a configuration for reciprocating a moving member of various types is adopted in a bending processing machine, a machine tool or the like of various types.

Further, for example, a configuration of a fluid pressure machine in a press machine for reciprocally moving a ram (slider) including a large-diameter cylinder and a small-diameter cylinder, and a reciprocable piston rod included in the small-diameter cylinder using a mechanical configuration such as a ball screw mechanism, thereby supplying a working fluid in the small-diameter cylinder to the large-diameter cylinder and obtaining significant power is disclosed in Japanese Patent Application Laid-Open No. 2002-295624 (Patent Document 1), for example.

As shown in FIG. 1, in the configuration of the Patent Document 1, the fluid pressure machine is configured so that a large-diameter cylinder 101 is provided, the large-diameter cylinder 101 includes therein a large-diameter piston 101P, and so that a large-diameter piston rod 101R protrudes from one side of the large-diameter piston 101P to serve as a ram. An interior of the large-diameter cylinder 101 is divided into a piston-side first compartment 101A and a piston rod-side second compartment 101B by the piston 101P.

Further, a small-diameter cylinder 103 is provided to supply a pressurized working fluid to the large-diameter cylinder 101. An interior of the small-diameter cylinder 103 is divided into a piston-side first compartment 103A and a piston rod-side second compartment 103B by a small-diameter piston 103P. A piston rod 103R provided on one side of the small-diameter piston 103P integrally is connected to a moving member 107 such as a ball nut reciprocably provided in a ball screw mechanism 105 rotation-driven by a motor M such as a servo motor.

The first compartment 101A of the large-diameter cylinder 101 is connected to the first compartment 103A of the small-diameter cylinder 103 by a connection path 109. The second compartment 101B of the large-diameter cylinder 101 is connected to the second compartment 103B of the small-diameter cylinder 103 by a connection path 111. An accumulator 113 is connected to the connection path 111.

By so configuring the fluid pressure machine, if the motor M is driven to press and move the small-diameter piston rod 103R upward, the working fluid in the first compartment 103A of the small-diameter cylinder 103 is supplied into the first compartment 101A of the large-diameter cylinder 101. The large-diameter piston 101P and the large-diameter piston rod 101R are moved downward, accordingly. The working fluid in the second compartment 101B of the large-diameter cylinder 101 flows into the second compartment 103B of the small-diameter cylinder 103. In an opposite operation, the working fluid in the second compartment 103B of the small-diameter cylinder 103 flows into the second compartment 101B of the large-diameter cylinder 101, and mat in the first compartment 101A in the large-diameter cylinder 101 flows into the first compartment 103A of the small-diameter cylinder 103.

As described above, during inflow and outflow of the working fluid between the first compartments 101A and 103A of the large-diameter cylinder 101 and the small-diameter cylinder 103 and between the second compartments 101B and 103B thereof, respectively, if it is assumed that a flow rate of each of the first compartments 101A and 103A is Q1 and that of each of the second compartments 101B and 103B is Q2, then a relationship of Q1>Q2 is satisfied, and Q1/Q2 needs to have a constant relationship.

Therefore, it is necessary to keep a pressure reception area ratio NA of the first compartment 101A to the second compartment 101B of the large-diameter cylinder 101 and a pressure reception area ratio NB of the first compartment 103A to the second compartment 103B of the small-diameter cylinder 103 to satisfy a relationship of NA=NB. Accordingly, if the large-diameter cylinder 101 is selected by, for example, a pressurization capability or the like of the press machine, the small-diameter cylinder 103 is decided uniquely to correspond to the large-diameter cylinder 101, thus disadvantageously restricting a degree of freedom for design.

Moreover, with the above-described configuration, the working fluid supplied from the small-diameter cylinder 103 enables the large-diameter piston rod 101R to reciprocate. Due to this, to make a stroke length of the large-diameter piston rod 101R large, it is disadvantageously necessary to increase a length of the small-diameter cylinder 103. Besides, if the large-diameter piston rod 101R is to move at high velocity, the velocity of the large-diameter piston rod 101R cannot be set almost equal to a moving velocity of the small-diameter piston rod 103R, thereby hampering improvement in efficiency by high-velocity movement of the ram.

Furthermore, with the conventional configuration, the working fluid such as working oil is simply filled up into the first compartment 101A and the second compartment 101B of the large-diameter cylinder 101 and the first compartment 103A and the second compartment 103B of the large-diameter cylinder 103. Due to this, to make power of the large-piston rod 101R large, it takes a relatively long time to raise an internal pressure of the first compartment 101A of the large-diameter cylinder 101 to a desired pressure, thereby disadvantageously hampering the improvement in efficiency.

The conventional fluid pressure machine is configured to reciprocate the large-diameter piston rod 101R while the large-diameter cylinder 101 is fixed. Due to this, a moving position of the large-diameter piston rod 101R relative to a fixing unit, such as a frame, fixing the large-diameter cylinder can be detected relatively easily. However, if it is configured so that the large-diameter piston rod 101R is fixed to the fixing unit and the large-diameter cylinder 101 is moved relative to the fixing unit, a position of the large-diameter cylinder 101 cannot be detected accurately only by detecting a rotation of the motor M. Therefore, a problem occurs that an expensive linear sensor or the like needs to be arranged between the fixing unit and the large-diameter cylinder 101.

The present invention has been achieved to solve the problems described above, and an object of the invention is to provide a ram position detection method, a ram driving method, a ram driving apparatus, and a press machine including the ram driving apparatus capable of normally moving a ram at high velocity and causing the ram to operate at low velocity when the ram performs a pressurization operation.

DISCLOSURE OF THE INVENTION

In order to achieve the object mentioned above, in accordance with a first aspect of the present invention, there is provided a ram driving method for a press machine, and the method drives a ram reciprocably included in a press machine, and the method includes the steps of: fixing one end of a large-diameter piston rod integral with a large-diameter piston reciprocably included in a large-diameter cylinder attached integrally to the ram; connecting one end of a small-diameter piston rod integral with a small-diameter piston reciprocably included in a small-diameter cylinder integral with the large-diameter cylinder to a moving member moved by motor driving; keeping the small-diameter cylinder and the small-diameter piston in a state of being moved integrally, and keeping a first compartment and a second compartment of a large-diameter cylinder divided by the large-diameter piston in a state of communicating with each other; moving both of the small-diameter cylinder and the large-diameter cylinder and the ram integrally with the small-diameter piton rod moved by the moving member; and keeping the small-diameter cylinder and the large-diameter cylinder in a state of communicating with each other, and moving the large-diameter cylinder and the ram with a strong force by a working fluid supplied from the small-diameter cylinder.

A ram driving method for a press machine according to a second aspect of the present invention is a ram driving method of driving a ram reciprocably included in a press machine, comprising the steps of: integrally providing a large-diameter cylinder reciprocably including a large-diameter piston rod connected to the ram and a small-diameter cylinder including a relatively movable small-diameter piston rod; connecting the small-diameter cylinder to a moving member moved by a motor, keeping a first compartment and a second compartment obtained by dividing the small-diameter cylinder by a small-diameter piston included integrally with the small-diameter piston rod in the small-diameter cylinder in a state of communicating with each other, integrally moving the large-diameter cylinder, the small-diameter cylinder, and the ram relatively to the small-diameter piton rod; and keeping the large-diameter cylinder and die small-diameter cylinder in a state of communicating with each other, and moving the large-diameter piston rod and the ram with a strong force by a working fluid supplied from the small-diameter cylinder to the large-diameter cylinder.

A press machine according to a third aspect of the present invention is a press machine including a reciprocable ram, comprising: a large-diameter cylinder and a small-diameter cylinder provided integrally with the ram; an on-off valve capable of communicating and shutting off the first compartment and the second compartment of the large-diameter cylinder with and from each other, which are divided by a reciprocable large-diameter piston included in the large-diameter cylinder, a reciprocable member provided integrally with a small-diameter piston rod integral with a small-diameter piston reciprocably included in the small-diameter cylinder, and reciprocated by motor driving; and a working fluid introduction path for introducing a working fluid pressurized by the small-diameter piston in the small-diameter cylinder into the first compartment or the second compartment of the large-diameter piston.

A press machine according to a fourth aspect of the present invention is a press machine including a reciprocable ram, comprising: a large-diameter cylinder for reciprocating the ram; and a small-diameter cylinder for supplying a pressurized working fluid to the large-diameter cylinder, wherein the large-diameter cylinder includes a large-diameter piston rod provided on both sides of a large-diameter piston in equal diameters reciprocably included in the large-diameter cylinder, one end of the large-diameter piston rod or the large-diameter cylinder itself is connected to the ram, the small-diameter cylinder includes a small-diameter piston rod provided on both sides of a small-diameter piston in equal diameters reciprocably included in the small-diameter cylinder, one end of the small-diameter piston rod or the small-diameter cylinder is connected to a moving member reciprocated by motor driving, and a first compartment and a second compartment of the large-diameter cylinder divided by the large-diameter piston are individually connected to a first compartment and a second compartment of the small-diameter cylinder divided by the small-diameter piston, respectively.

A press machine according to a fifth aspect of the present invention dependent on the third aspect or the fourth aspect is configured, in addition to the above-described configuration, so that a counterbalance valve is provided on a connection path connecting the large-diameter cylinder to the small-diameter cylinder.

A ram driving method for a press machine according to a sixth aspect of the present invention is a method of driving a reciprocable ram included in a press machine, comprising the steps of: fixing one end of a large-diameter piston rod integral with a large-diameter piston reciprocably included in a large-diameter cylinder attached integrally to the ram; connecting one end of a small-diameter piston rod integral with a small-diameter piston reciprocably included in a small-diameter cylinder integral with the large-diameter cylinder to a moving member moved by motor driving; keeping the small-diameter cylinder and the small-diameter piston in a state of being moved integrally, and keeping a first compartment and a second compartment of the large-diameter cylinder divided by the large-diameter piston in a state of communicating with each other, moving both of the small-diameter cylinder and the large-diameter cylinder and the ram integrally with the small-diameter piton rod moved by the moving member, keeping the small-diameter cylinder and the large-diameter cylinder in a state of communicating with each other, and moving the large-diameter cylinder and the ram with a strong force by a working fluid supplied from the small-diameter cylinder, and causing an accumulator connected to the first compartment to adjust a difference in inflow and outflow amounts of a working fluid between the first (compartment and the second compartment when the small-diameter cylinder and the large-diameter cylinder are kept to communicate with each other and the large-diameter cylinder and the ram are moved with a strong force by the working fluid supplied from the small-diameter cylinder.

A press machine according to a seventh aspect of the present invention is a press machine including a reciprocable ram, comprising: a large-diameter cylinder and a small-diameter cylinder included integrally with the ram; an on-off valve capable of communicating and shutting off a first compartment and a second compartment divided by a large-diameter piston reciprocably included in the large-diameter cylinder with and from each other, a reciprocable member provided integrally with a small-diameter piston rod integral with a small-diameter piston reciprocably included in the small-diameter cylinder, and reciprocated by motor driving; and a working fluid introduction path for introducing a working fluid pressurized by the small-diameter piston in the small-diameter cylinder into the first compartment or the second compartment of the large-diameter piston, wherein a piston rod diameter on a second compartment side is configured to be larger man a piston rod diameter on a first compartment side in the large-diameter cylinder, and an accumulator is connected to the first compartment side.

According to the first aspect to the seventh aspect of the present invention, the ram can be moved at high velocity almost equal to a moving velocity of the mechanically moved moving member to move integrally with the moving member moved by motor driving. Furthermore, the pressurization operation of the ram is performed by pressurization using the working fluid supplied from the small-diameter cylinder to the large-diameter cylinder. Accordingly, by making a pressure reception area ratio of the small-diameter cylinder to the large-diameter cylinder, it is possible to cause the ram to operate at low velocity and to obtain a strong pressurization force.

A ram driving apparatus according to an eighth aspect of the present invention is a ram driving apparatus driving a ram reciprocated by a fluid pressure mechanism, wherein a large-diameter cylinder attached integrally to the ram is divided into a first compartment and a second compartment by a large-diameter piston relatively reciprocably included in the large-diameter cylinder, and one end of a large-diameter piston rod protruding from the large-diameter cylinder integrally with the large-diameter piston is fixed to a fixing unit, a small-diameter cylinder integral with the large-diameter cylinder is divided into a first compartment and a second compartment by a small-diameter piston relatively reciprocably included in the small-diameter cylinder, and one end of a small-diameter piston rod protruding from the small-diameter cylinder integrally with the small-diameter piston is connected to a moving member moved by motor driving, and the first compartment of the large-diameter cylinder is connected to the first compartment of the small-diameter cylinder via a connection path, and the second compartment of the large-diameter cylinder is connected to the second compartment of the small-diameter cylinder via a connection path, internal pressures of the first compartment and the second compartment of each of the large-diameter cylinder and the small-diameter cylinder are pressurized to a predetermined pressure equal to or higher than an atmospheric pressure.

A ram driving apparatus according to a ninth aspect of the present invention dependent on the eighth aspect includes, in addition to the above-described configuration, a pressure application unit that applies a pressure equal to or higher than the atmospheric pressure into fluid pressure circuit of the large-diameter cylinder and the small-diameter cylinder.

A press machine according to a tenth aspect of the present invention dependent on the eighth aspect or the ninth aspect includes, in addition to the above-described configuration, an integral fixing unit capable of integrating the small-diameter cylinder with the small-diameter piston rod.

A ram driving apparatus according to an eleventh aspect of the present invention dependent on the tenth aspect includes, in addition to the above-described configuration, a position detection unit that detects relative moving positions of the small-diameter cylinder and the small-diameter piston rod included in the integral fixing unit.

According to the eighth aspect to the eleventh aspect of the present invention, the ram can be moved at high velocity almost equal to a moving velocity of the mechanically moved moving member to move integrally with the moving member moved by motor driving. Furthermore, the pressurization operation of the ram is performed by pressurization using the working fluid supplied from the small-diameter cylinder to the large-diameter cylinder. Accordingly, by making a pressure reception area ratio of the small-diameter cylinder to the large-diameter cylinder high, it is possible to cause the ram to operate at low velocity and to obtain a strong pressurization force.

Furthermore, the internal pressures of the first compartment and the second compartment of each of the large-diameter cylinder and the small-diameter cylinder are pressurized to the predetermined pressure equal to or higher than the atmospheric pressure. To obtain significant power from the large-diameter cylinder, it is possible to shorten the time for raising the pressure of the first or second compartment in the large-diameter cylinder to a desired pressure and to improve efficiency.

A ram position detection method according to a twelfth aspect of the present invention is a ram position detection method for a ram driving apparatus configured so that first compartments of a large-diameter cylinder and a small-diameter cylinder provided integrally with a ram reciprocably included in a frame are connected to each other and so that second compartments of the large-diameter cylinder and the small-diameter cylinder are connected to each other, and comprising the steps of: detecting a relative moving position of the small-diameter cylinder to the frame, and detecting relative moving positions of the small-diameter piston rod included in the small-diameter cylinder and the small-diameter cylinder, and detecting a moving position of the ram to the frame based on the detected values of both detections.

A ram driving apparatus according to a thirteenth aspect of the present invention is a ram driving apparatus configured so mat first compartments of a large-diameter cylinder and a small-diameter cylinder provided integrally with a ram reciprocably included in a frame are connected to each other and second compartments of the large-diameter cylinder and the small-diameter cylinder are connected to each other, and comprising: a first position detection unit that detects a relative moving position of the small-diameter cylinder to the frame; and a second position detection unit that detects relative moving positions of a small-diameter piston rod included in the small-diameter cylinder and the small-diameter cylinder.

A ram driving apparatus according to a fourteenth aspect of the present invention dependent on the thirteenth aspect is configured, in addition to the above-described configuration, so that the second position detection unit includes a rotational operation mechanism rotationally operating during a relative movement of the small-diameter piston rod to the small-diameter cylinder, and is configured to detect a rotation of the rotational operation mechanism.

According to the twelfth aspect to the fourteenth aspect of the present invention, it is possible to select a desired diameter for each of the large-diameter cylinder and the small-diameter cylinder, thus ensuring a high degree of freedom for design. Further, since the moving position of the small-diameter cylinder relative to the frame and the relative moving position of the small-diameter piston rod relative to the small-diameter cylinder are detected, it is possible to detect a moving position of a slider moved integrally with the small-diameter cylinder to the fixing unit such as the frame and a moving velocity of the slider.

BEST MODE FOR CARRYING OUT THE INVENTION

Embodiments of the present invention are explained below with reference to the drawings.

Figure 2:
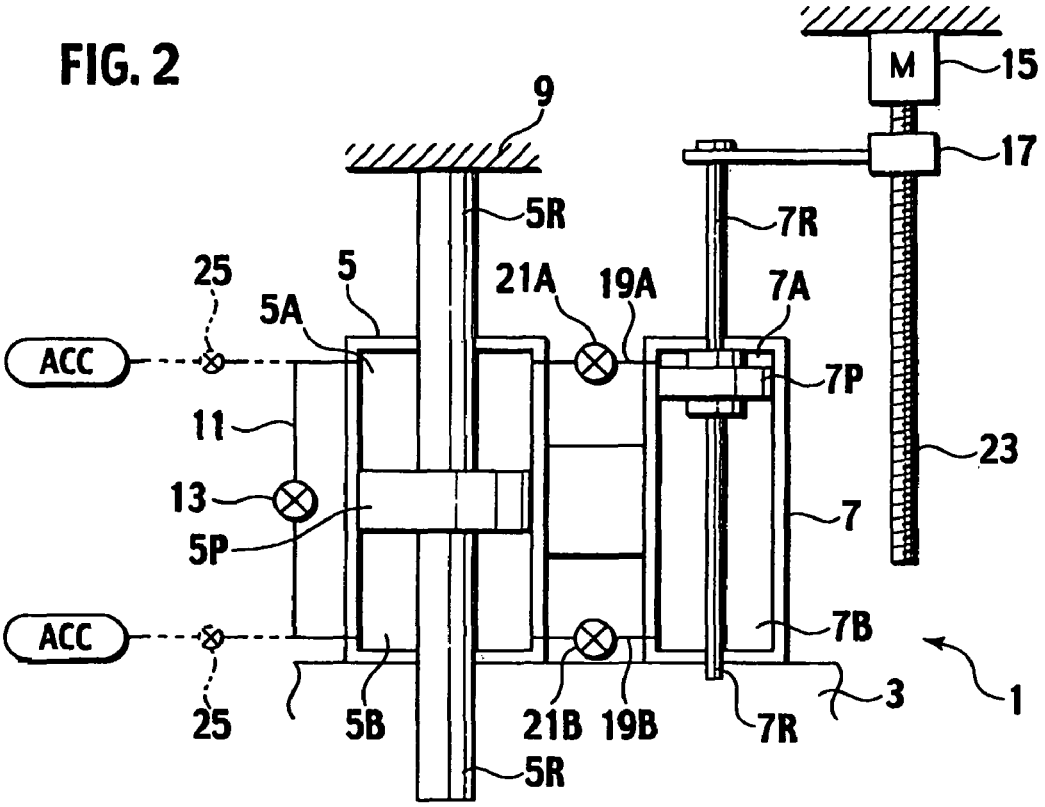
FIG. 2 is an explanatory diagram conceptually and schematically showing a press machine according to a first embodiment of the present invention.

With reference to FIG. 2 conceptually and schematically showing an embodiment of the present invention, a press machine (pressurizer) 1 according to the present embodiment includes a reciprocable ram 3. A large-diameter cylinder 5 and a small-diameter cylinder 7 are attached integrally to the ram 3. The large-diameter cylinder 5 and the small-diameter cylinder 7 can be attached to one cylinder block as a unit to make the press machine 1 compact.

A large-diameter piston 5P is reciprocably inserted into the large-diameter cylinder 5, and a large-diameter piston rod 5R is provided in equal diameters on both sides of the large-diameter piston 5P so that ends of the large-diameter piston rod 5R protrude outward from the large-diameter cylinder 5, respectively. One end or both ends of the large-diameter piston rod 5R is/are fixedly connected to a fixing unit 9, e.g., a frame, of the press machine 1. An interior of the large-diameter cylinder 5 is divided into a first compartment 5A and a second compartment 5B by the large-diameter piston 5P. An on-off valve, e.g., a solenoid valve, capable of freely shutting off a communication between the first compartment 5A and the second compartment 5B is arranged on a connection path 11 communicably connecting the first compartment 5A to the second compartment 5B.

A small-diameter piston 7P is reciprocably inserted into the small-diameter cylinder 7, and a small-diameter piston rod 7R is provided in equal diameters on both sides of the small-diameter piston 7P so that ends of the small-diameter piston rod 7R protrude outward from the small-diameter cylinder 7, respectively. One end of the small-diameter piston rod 7R is connected to a moving member 17 reciprocated by driving a motor 15.

An interior of the small-diameter cylinder 7 is divided into a first compartment 7A and a second compartment 7B by the small-diameter piston 7P. The first compartment 7A of the small-diameter cylinder 7 is connected to the first compartment 5A of the large-diameter cylinder 5 via a connection path 19A that is one example of a working fluid introduction path, and a switch valve (an on-off valve) 21A, e.g., a solenoid valve, is arranged on the connection path 19A. The second compartment 7B of the small-diameter cylinder 7 is connected to the second compartment 5B of the large-diameter cylinder 5 via a connection path 19B, and a switch valve (an on-off valve) 21B is arranged on the connection path 19B.

A pressure reception area of the large-diameter piston 5P is set several times as large as that of the small-diameter piston 7P. The large-diameter cylinder 5 and the small-diameter cylinder 7 are set to be almost equal in length. It is to be noted that the large-diameter cylinder and the small-diameter cylinder do not mean magnitudes of diameters of the cylinders but magnitudes of the pressure reception areas of the inserted pistons. Further, the small-diameter cylinder 7 can be either longer or shorter than the large-diameter cylinder 5.

Any member can be used as the moving member 17 as long as the member is configured to be reciprocated either directly or indirectly by rotation driving of the motor 15. In this embodiment, a ball nut moved by rotating a ball screw 23 using the motor 15 is shown as an example of the moving member 17. However, a configuration for reciprocating the moving member 17 is not limited to the ball screw mechanism described above, but can be an arbitrary mechanism.

With the above-described configuration, when the motor 15 is rotation-driven to move the moving member 17 downward while the small-diameter piston 7P abuts on an upper end of the small-diameter cylinder 7 to be kept to move downward integrally with the small-diameter cylinder 7, the on-off valve 13 is kept open, and the first compartment 5A and the second compartment 5B of the large-diameter cylinder 5 keep communicating with each other, the state in which the small-diameter piston 7P abuts on the upper end of the small-diameter cylinder 7 is held by a weight of the ram 3 and the ram 3 moves downward by its own weight. At this time, in the large-diameter cylinder 5, the working fluid flows from the first compartment 5A into the second compartment 5B, and a falling velocity of the ram 3 or the like is as high as that of the moving member 17.

With the configuration shown in FIG. 2, by keeping both the on-off valves 21A and 21B closed and locking the small-diameter cylinder 7, the ram 3 can be move downward at higher velocity than the falling velocity by its own weight.

If the ram 3 is moved downward to perform a pressurization operation as described above, the on-off valve 13 is closed. Further, if the on-off valves 21A and 21B are kept closed, the on-off valve 13 is left open. Accordingly, the small-diameter piston 7P is moved downward relatively to the small-diameter cylinder 7, and the working fluid in the second compartment 7B of the small-diameter cylinder 7 is pressurized by the small-diameter piston 7P, and flows into the second compartment 5B of the large-diameter cylinder 5. The working fluid in the first compartment 5A of the large-diameter cylinder 5 flows into the first compartment 7A of the small-diameter cylinder 7. At this time, a flow rate of the working fluid flowing from the second compartment 7B of the small-diameter cylinder 7 is equal to that of the working fluid flowing into the first compartment 7A.

As described above, if the working fluid is supplied from the second compartment 7B of the small-diameter cylinder 7 to the second compartment 5B of the large-diameter cylinder 5 to move the ram 3 downward, the falling velocity of the ram 3 becomes lower and the pressurization force becomes stronger to correspond to a pressure reception area ratio of the large-diameter piston 5P to the small-diameter piston 7P. If the ram 3 is moved upward, it suffices to move the moving member 17 upward. In this case, similarly to the above case, the ram 3 can be moved upward either at low velocity or at high velocity. At this time, by keeping the switch valves (on-off valves) 21A and 21B closed and the on-off valve 13 open, the ram 3 can be moved upward at high velocity just from a falling position.

Figure 1:
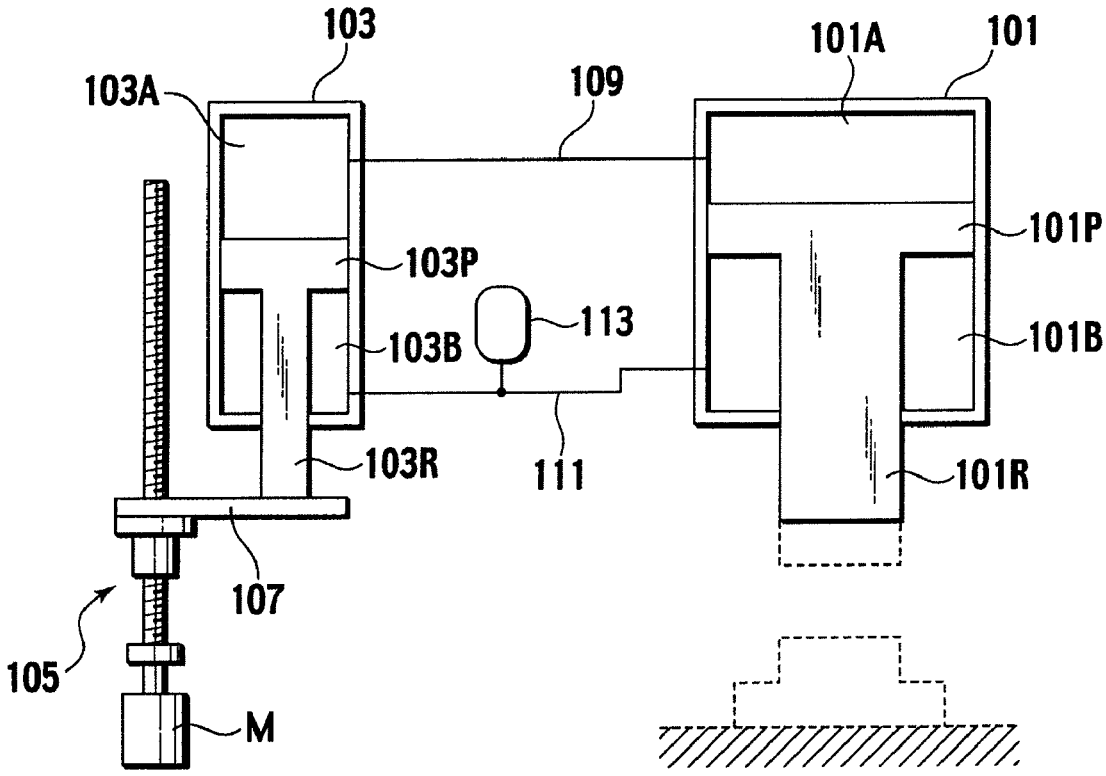
FIG. 1 is an explanatory diagram of a conventional press machine.

Meanwhile, a case that the ram 3 located at a rising position in an initial state is moved downward at high velocity has been described. However, some press brakes, as one example of the press machine, are configured to move a lower table (ram) upward from a falling position. If the present invention is to be applied to such a press machine configured to move the lower table (ram) upward, the configuration shown in FIG. 1 can be turned upside down.

With the configuration turned upside down, to move the ram 3 upward at high velocity integrally by moving the moving member 17 upward from the falling position, it suffices that the on-off valve 13 is kept open, one of or each of the switch valves 21A and 21B is kept closed, and mat the small-diameter piston 7P is kept locked so that it moves integrally with the small-diameter cylinder 7 without moving the small-diameter piston 7P relatively to the small-diameter cylinder 7. Thereafter, if the operation is moved to the pressurization operation performed by the ram 3, it suffices to keep the on-off valve 13 closed and the switch valves 21A and 21B open similarly to the above-described configuration.

A case that the large-diameter piston rod 5R is fixed to the fixing unit 9 and the large-diameter cylinder 5 is moved has been described. However, whether the large-diameter piston rod 5R or the large-diameter cylinder 5 is fixed is only a relative decision as to whether an output of the fluid pressure cylinder is a cylinder side or a piston rod side. Accordingly, the press machine can be configured so that the large-diameter cylinder 5 is fixed to the fixing unit 9 and so that the large-diameter piston rod 5R is connected to the ram 3.

Moreover, a moving direction of the small-diameter piston 7P on the small-diameter cylinder 7 side can be set either identical or opposite to that of the large-diameter piston 5P on the large-diameter cylinder 5 side. Namely, the press machine can be configured to connect the first compartment 7A of the small-diameter cylinder 7 to the second compartment 5B of the large-diameter cylinder 5 and to connect the second compartment 7B of the small-diameter cylinder 7 to the first compartment 5A of the large-diameter cylinder 5.

Furthermore, a case of the configuration in which the first compartment 5A and the second compartment 5B of the large diameter cylinder 5 are connected to each other via the connection path 11 has been described. If the press machine is configured so that an accumulator ACC is connected to each of the first compartment 5A and the second compartment 5B via an on-off valve 25, the connection path 11 can be omitted. In this way, if the press machine is configured to connect the accumulator ACC to each of the first compartment 5A and the second compartment 5B, it can operate in a case that flow rates of the working fluid flowing into or out of the first compartment 5A and the second compartment 5B from or into the small-diameter cylinder 7 side differ.

Therefore, with the above-described configuration, the piston rods 5R and 7R provided below the pistons 5P and 7P of the large-diameter cylinder 5 and the small-diameter cylinder 7, respectively, for example, can be omitted and the pressure reception area of the piston 5P can be made larger. If the ram 3 needs to perform the pressurization operation, the on-off valve 25 can be kept closed not to cause the working fluid to flow into the accumulator ACC connected to the second compartment 5B, for example.

Figure 3:
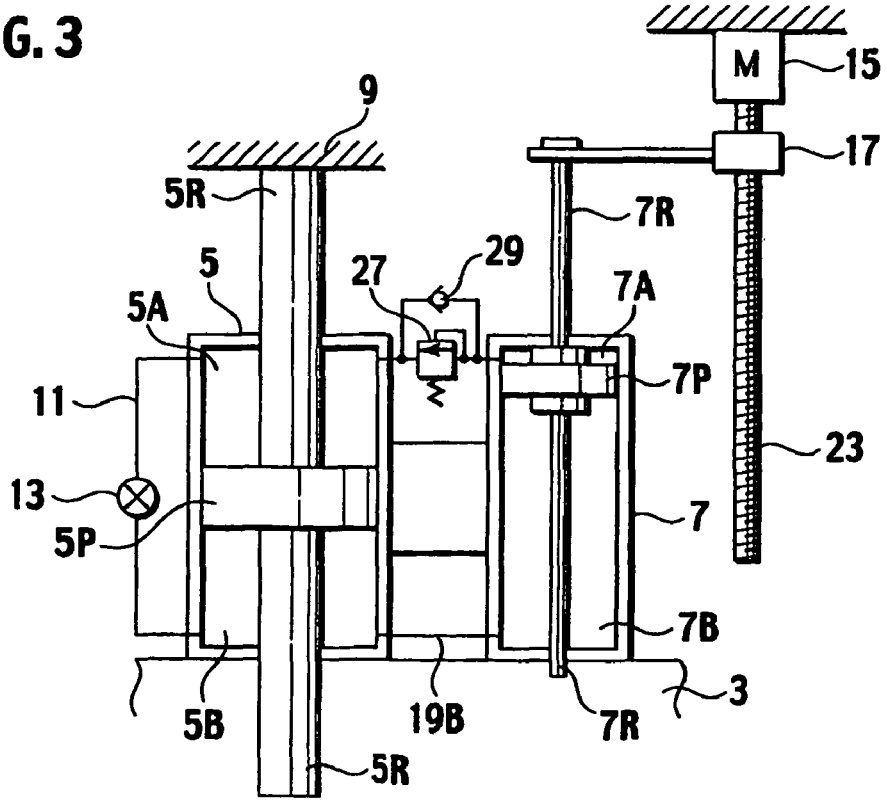
FIG. 3 is an explanatory diagram conceptually and schematically showing a press machine according to a second embodiment of the present invention.

FIG. 3 shows a second embodiment. Constituent elements identical in function to those according to the above embodiment are denoted by like reference symbols and therefore redundant descriptions thereof will be omitted.

In the second embodiment, a press machine is configured to include a relief valve or counterbalance valve 27 on a part of the connection path 19A to permit the working fluid to flow from the first compartment 7A of the small-diameter cylinder 7 into the first compartment 5A of the large-diameter cylinder 5 when a fluid pressure in the first compartment 7A of the small-diameter cylinder 7 is equal to or higher than a pressure corresponding to the weight of the ram 3 or the like, and to include a check valve 29 arranged in parallel to the counterbalance valve 27 to permit inflow of the working fluid from the first compartment 5A into the first compartment 7A but prevent back-flow of the working fluid. Further, the press machine is configured not to include the switch valve 21B provided on the connection path 19B.

With the configuration according to the second embodiment, similarly to that according to the first embodiment, the small-diameter cylinder 7, the large-diameter cylinder 5, and the ram 3 can be moved downward integrally with one another at high velocity by moving the moving member 17 downward by rotation of the motor 5. Further, by continuously moving the moving member 17 downward and keeping the on-off valve 13 closed, the small-diameter cylinder 7, the large-diameter cylinder 5, and the ram 3 can be moved downward at low velocity similarly to the above and the ram 3 performs the operation.

Thereafter, if the on-off valve 13 is turned open and the motor 15 is rotated oppositely to raise the ram 3, the moving member 17 is raised at high velocity. At this time, the working fluid in the first compartment 7A of the small-diameter cylinder 7 is prevented from flowing into the first compartment 5A of the large-diameter cylinder 5. Therefore, the large and small cylinders 5 and 7 and the ram 3 are moved upward at high velocity integrally with the moving member 17. When the large-diameter cylinder 5 reaches an upper limit and abuts on the large-diameter piston 5P, the small-diameter piston rod 7R and the small-diameter piston 7P are moved upward relatively to the small-diameter cylinder 7, thus increasing an internal pressure of the first compartment 7A.

If the pressure of the working fluid in the first compartment 7A of the small-diameter cylinder 7 is increased as described above, then the counterbalance valve 27 is made communicable and the working fluid in the first compartment 7A flows into the first compartment 5A of the large-diameter cylinder 5. At this time, the first compartment 5A communicates with the second compartment 5B in the large-diameter cylinder 5, and the second compartments 5B and 7B of the large and small cylinders 5 and 7 communicate with each other, so that the large and small cylinders 5 and 7 and the ram 3 are in states of stopping at their upper limit positions, respectively. Namely, with the configuration according to the second embodiment, it is possible to promptly return the ram 3 to moving upward. Moreover, various modifications can be made similarly to the first embodiment.

Figure 4:
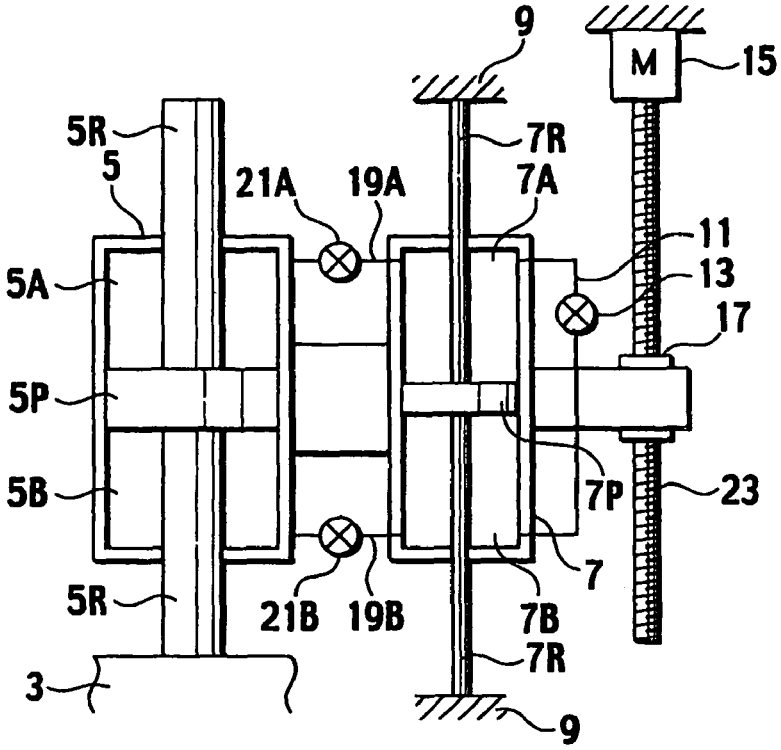
FIG. 4 is an explanatory diagram conceptually and schematically showing a press machine according to a third embodiment of the present invention.

FIG. 4 shows a third embodiment. Constituent elements identical in function to those according to the above embodiments are denoted by like reference symbols and therefore redundant descriptions thereof will be omitted.

In the third embodiment, the large and small cylinders 5 and 7 provided integrally are connected to the moving member 17 integrally and the small-diameter piston rod 7R of the small-diameter cylinder 7 is fixed to the fixing unit 9. Furthermore, the press machine is configured so that the ram 3 is provided integrally with the large-diameter piston rod 5R of the large-diameter cylinder 5 and so that the first compartment 7A and the second compartment 7B of the small-diameter cylinder 7 are connected to each other by the connection path 11.

With the above-described configuration, if the motor 15 is driven and the ball screw 23 is rotated while the on-off valve 13 provided on the connection path 11 is kept open and the switch valves 21A and 21B are kept closed, the large and small cylinders 5 and 7, the large-diameter piston rod 5R, and the ram 3 are moved vertically to be integral with the moving member 17 and can be moved at high velocity by a mechanical configuration. By keeping the on-off valve 13 closed and the switch valves 21A and 21B open, the working fluid pressurized on the small-diameter cylinder 7 side is supplied to the first compartment 5A (when the ram 3 is moved downward) or to the second compartment 5B (when the ram 3 is moved upward) of the large-diameter cylinder 5. The state can be thereby turned into a pressurization operation state of moving the ram 3 at low velocity with strong force.

Similarly to the first embodiment, various modifications can be made of the third embodiment such as a modified configuration in which the accumulator is connected to each of the first compartment 5A and the second compartment 5B of the large-diameter cylinder 5.

As can be understood from the descriptions of the above embodiments, a relationship between the pressure reception area of the large-diameter piston 5P of the large-diameter cylinder 5 and that of the small-diameter piston 7P of the small-diameter cylinder 7 is not decided uniquely but can be designed with a high degree of freedom. Furthermore, it is possible to facilitate switchover from high-velocity movement of the ram 3 to low-velocity pressurization operation thereof, and to accelerate velocity and improve efficiency.

In the respective embodiments, it is preferable that an accumulator for absorbing a volume change of the working fluid due to a temperature change or the like is provided in at least one of the first compartment 5A and the second compartment 5B of the large-diameter cylinder 5.

Figure 5:
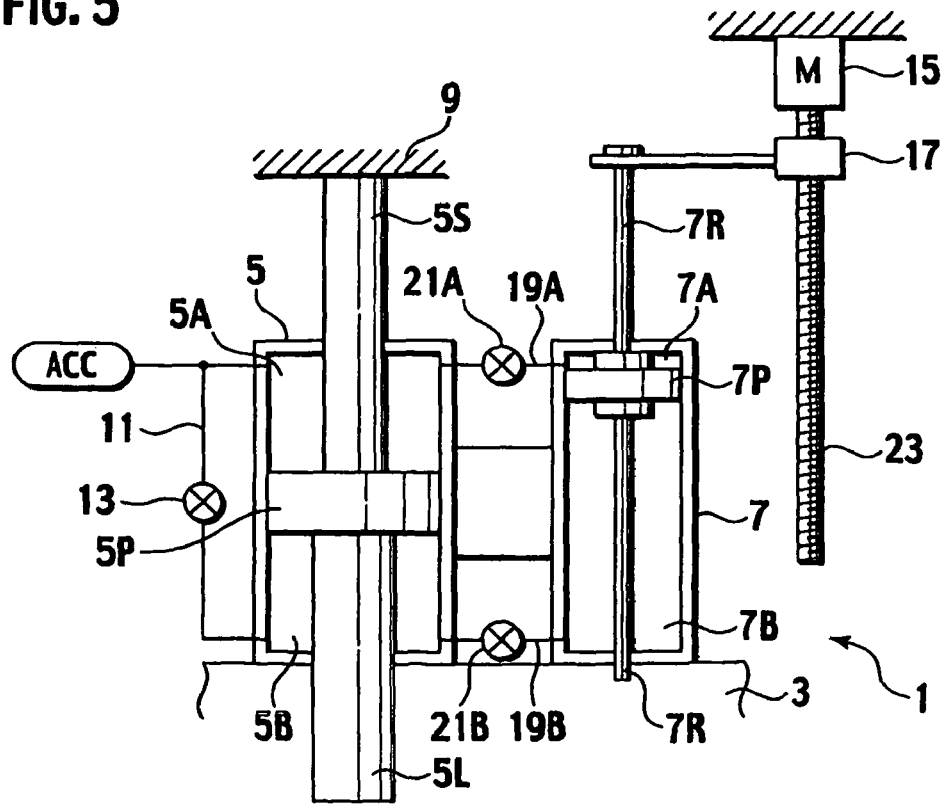
FIG. 5 is an explanatory diagram conceptually and schematically showing a press machine according to a fourth embodiment of the present invention.

FIG. 5 shows a fourth embodiment. Constituent elements identical in function to those according to the above embodiments are denoted by like reference symbols and therefore redundant descriptions thereof will be omitted.

The fourth embodiment is a modified embodiment of the first embodiment described above. A diameter of a piston rod 5L on the second compartment 5B side is made larger than that of a piston rod 5S on the first compartment 5A side in the large-diameter cylinder 5, and the pressure reception area of the first compartment 5A side is made larger man that of the second compartment 5B side on the piston 5P. Further, the press machine is configured so that a pressure accumulated in the accumulator ACC always acts on the first compartment 5A.

With the above-described configuration, if the on-off valve 13 is kept open, the pressure accumulated in the accumulator ACC acts on the first and second compartments 5A and 5B of the large-diameter cylinder 5. Due to this, the internal pressure of the first compartment 5A acts to move the large-diameter cylinder 5 and the ram 3 upward to correspond to a difference in pressure reception area between the first compartment 5A and the second compartment 5B. Therefore, by keeping balance between the weight of the ram 3 or the like and the pressure acting into the first compartment 5A, it is possible to prevent the ram 3 from being moved downward inadvertently and to improve safety.

Moreover, with the above-described configuration, the pressure accumulated in the accumulator ACC always acts on the first compartment 5A of the large-diameter cylinder 5. Due to this, when the on-off valve 13 is kept open, the weight of the ram 3 or the like acting on the moving member 17 supporting the ram 3 or the like via the small-diameter cylinder 7 can be reduced. It is, therefore, possible to reduce the burden oh the motor 15 for reciprocably moving the moving member 17 and to downsize the motor 15.

If the moving member 17 is moved by the motor 15 to vertically move the ram 3, the difference in inflow and outflow amounts of the working fluid is generated between the first compartment 5A and the second compartment 5B due to the difference in pressure reception area between the first compartment 5A and the second compartment 5B of the large-diameter cylinder 5. However the difference in inflow and outflow amounts of the working fluid between the first compartment 5A and the second compartment 5B can be regulated by flow of the working fluid from or into the accumulator ACC. In other words, the accumulator ACC regulates the difference in inflow and outflow amounts of the working fluid between the first compartment 5A and the second compartment 5B, so mat no problem occurs even if the difference in inflow and outflow amounts of the working fluid occurs.

The present invention is not limited to the embodiments described above, but can be carried out in other aspects by making appropriate changes. Namely, the case of vertically moving the ram (pressurization member moved by the large-diameter cylinder) has been described above. However, the present invention is also applicable to a pressurizer of various types for horizontally moving the pressurization member (ram) by the large-diameter cylinder serving as a fluid pressure driving source.

A fifth embodiment of the present invention is described next with reference to FIG. 6. In the fifth embodiment, a case that a slider driving device for driving a slider reciprocated by a fluid pressure mechanism is applied to a press machine is described. However, the present invention is not limited to the press machine but can be also applied to a configuration of, for example, a bending processing machine or a machine tool of various types for driving a moving member of various types to serve as a slider movable vertically, horizontally or the like.

A press machine (pressurizer) 1 according to this embodiment includes a ram 3 that is one example of a reciprocable slider (moving member). A large-diameter cylinder 5 and a small-diameter cylinder 7 are attached integrally to the ram (slider) 3. Because of the integral configuration of the large-diameter cylinder 5 with the small-diameter cylinder 7, both can be attached to one cylinder block as a unit to make the press machine 1 compact.

A large-diameter piston 5P is reciprocably inserted into the large-diameter cylinder 5, and a large-diameter piston rod 5R is provided in equal diameters on both sides of the large-diameter piston 5P so that ends of the large-diameter piston rod 5R protrude outward from the large-diameter cylinder 5, respectively. One end or both ends of the large-diameter piston rod 5R is/are fixedly connected to a fixing unit 9, e.g., a frame, of the press machine 1. An interior of the large-diameter cylinder 5 is divided into a first compartment 5A and a second compartment 5B by the large-diameter piston 5P. An on-off valve, e.g., a solenoid valve, capable of freely shutting off a communication between the first compartment 5A and the second compartment 5B is arranged on a connection path 11 communicably connecting the first compartment 5A to the second compartment 5B.

A small-diameter piston 7P is reciprocably inserted into the small-diameter cylinder 7, and a small-diameter piston rod 7R is provided in equal diameters on both sides of the small-diameter piston 7P so that ends of the small-diameter piston rod 7R protrude outward from the small-diameter cylinder 7, respectively. One end of the small-diameter piston rod 7R is connected to a moving member 17, such as a servomotor, reciprocated by driving the motor 15.

An interior of the small-diameter cylinder 7 is divided into a first compartment 7A and a second compartment 7B by the small-diameter piston 7P. The first compartment 7A of the small-diameter cylinder 7 is connected to the first compartment 5A of the large-diameter cylinder 5 via a connection path 19A that is one example of a working fluid introduction path, and a switch valve (an on-off valve) 21A, e.g., a solenoid valve, is arranged on the connection path 19A. The second compartment 7B of the small-diameter cylinder 7 is connected to the second compartment 5B of the large-diameter cylinder 5 via a connection path 19B.

Furthermore, the first compartment 7A and the second compartment 7B of the small-diameter cylinder 7 are connected to each other via a connection path 31, and an on-off valve (a switch valve) 31A, e.g., a solenoid valve, capable of freely shutting off a communication of the connection path 31 is arranged on the connection path 31.

A pressure reception area of the large-diameter piston 5P is set several times as large as that of the small-diameter piston 7P. It is to be noted that the large-diameter cylinder and the small-diameter cylinder do not mean magnitudes of diameters of the cylinders but magnitudes of the pressure reception areas of the inserted pistons. Further, the small-diameter cylinder 7 can be equal, longer or shorter than the large-diameter cylinder 5.

Any member can be used as the moving member 17 as long as the member is configured to be reciprocated either directly or indirectly by rotation driving of the motor 15. In this embodiment, a ball nut moved by rotating a ball screw 23 via a power transmission mechanism such as a timing belt using the motor 15 is shown as the moving member 17. However, a configuration for reciprocating the moving member 17 is not limited to the ball screw mechanism described above, but can be an arbitrary mechanism.

Figure 6:
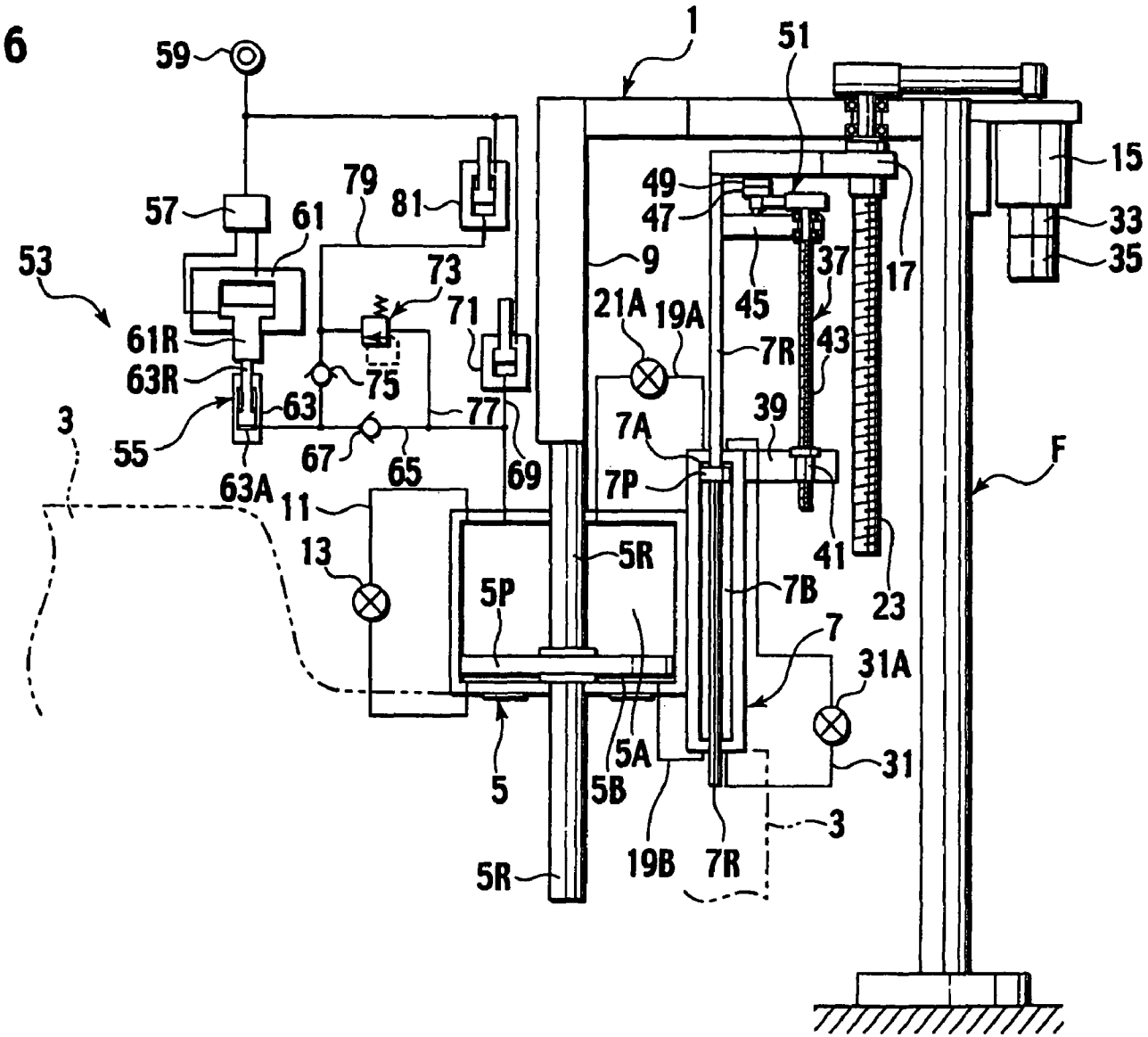
FIG. 6 is an explanatory diagram conceptually and schematically showing a press machine according to a fifth embodiment of the present invention.

With the above-described configuration, as shown in FIG. 6, when the motor 15 is rotation-driven to move the moving member 17 downward while the small-diameter piston 7P abuts on an upper end of the small-diameter cylinder 7 to be kept to move downward integrally with the small-diameter cylinder 7, the on-off valve 13 is kept open, and the first compartment 5A and the second compartment 5B of the large-diameter cylinder 5 keep communicating with each other, the state in which the small-diameter piston 7P abuts on the upper end of the small-diameter cylinder 7 is held by a weight of the ram 3 and the ram 3 moves downward by its own weight. At this time, in the large-diameter cylinder 5, the working fluid flows from the first compartment 5A into the second compartment 5B, and a falling velocity of the ram 3 or the like is as high as that of the moving member 17.

With the configuration shown in FIG. 6, by rotating the motor 15 at high velocity while keeping both the on-off valves 21A and 31B closed and locking the small-diameter cylinder 7, the ram 3 can be moved downward at higher velocity man the falling velocity by its own weight.

In this manner, if the small-diameter 7 is held locked and the large-diameter cylinder 5 and the ram 3 are moved integrally, a moving position and a moving velocity of the ram (slider) 3 relative to the fixing unit such as a frame F can be detected by detecting rotation of the motor 15 or the ball screw 23.

If the ram 3 is moved downward to perform a pressurization operation as described above, the on-off valve 13 is closed. Further, if the on-off valve 21A is kept closed, the on-off valve 13 is left open. Accordingly, the small-diameter piston 7P is moved downward relatively to the small-diameter cylinder 7, and the working fluid in the second compartment 7B of the small-diameter cylinder 7 is pressurized by the small-diameter piston 7P, and flows into the second compartment 5B of the large-diameter cylinder 5. The working fluid in the first compartment 5A of the large-diameter cylinder 5 flows into the first compartment 7A of the small-diameter cylinder 7. At this time, a flow rate of the working fluid flowing from the second compartment 7B is equal to that of the working fluid flowing into the first compartment 7A in the small-diameter cylinder 7.

As described above, if the working fluid is supplied from the second compartment 7B of the small-diameter cylinder 7 to the second compartment 5B of the large-diameter cylinder 5 to move the ram 3 downward, the falling velocity of the ram 3 becomes lower and the pressurization force becomes stronger to correspond to a pressure reception area ratio of the large-diameter piston 5P to the small-diameter piston 7P. If the ram 3 is moved upward, it suffices to move the moving member 17 upward. In this case, similar to the above case, the ram 3 can be moved upward either at low velocity or at high velocity. At this time, by keeping the switch valves (on-off valves) 21A and 31A closed and the on-off valve 13 open, the ram 3 can be moved upward at high velocity just from a falling position corresponding to the rotation velocity of the motor 15.

Meanwhile, if the on-off valve 31A is kept open, then the first compartment 7A and the second compartment 7B of the small-diameter cylinder 7 are turned into communicable states, and the small-diameter piston 7P and the small-diameter piston rod 7R can be moved relatively to the small-diameter cylinder 7 without supplying the working fluid from the small-diameter cylinder 7 side to the large-diameter cylinder 5 side.

A case mat the large-diameter piston rod 5R is fixed to the fixing unit 9 and the large-diameter cylinder 5 is moved has been described. However, whether the large-diameter piston rod 5R or the large-diameter cylinder 5 is fixed is only a relative decision as to whether an output of the fluid pressure cylinder is a cylinder side or a piston rod side. Accordingly, the press machine can be configured so that the large-diameter cylinder 5 is fixed to the fixing unit 9 and so that the large-diameter piston rod 5R is connected to the ram 3.

Moreover, a moving direction of the small-diameter piston 7P on the small-diameter cylinder 7 side can be set either identical or opposite to that of the large-diameter piston 5P on the large-diameter cylinder 5 side. Namely, the press machine can be configured to connect the first compartment 7A of the small-diameter cylinder 7 to the second compartment 5B of the large-diameter cylinder 5 and to connect the second compartment 7B of the small-diameter cylinder 7 to the first compartment 5A of the large-diameter cylinder 5.

Furthermore, the above-described configuration can be replaced by a configuration in which an accumulator is connected to the first compartment 5A and the second compartment 5B of the large-diameter cylinder 5 via on-off valves, respectively so that the working fluid flows from or into the first compartment 5A and the second compartment 5B into or from the accumulator, respectively. In this case, the connection path 11 and the on-off valve 13 can be omitted.

As already understood, with the above-described configuration, the ram 3 can be moved at high velocity to be interlocked with a rotational velocity of the motor 15, and the ram 3 can be moved at low velocity with significant power by supplying the working fluid from the small-diameter cylinder 7 to the large-diameter cylinder 5 to actuate the ram 3.

The motor 15 includes a rotational position detection unit 33 such as a rotary encoder and a fixing unit 35 such as a brake to detect moving positions of the small-diameter cylinder 7, the large-diameter cylinder 5, and the ram (slider) 3 they are moved, for example, from reference positions serving as uppermost rising positions by rotating the ball screw 23 by rotation-driving of the motor 15, and to keep the motor 5 in a fixed state, respectively.

The rotational position detection unit 33 can detect moving positions and moving velocities of the small-diameter cylinder 7 and the like when they are moved from their respective reference positions via the moving member 17 by the rotation-driving of the motor 15. Further, by actuating the brake that is one example of the fixing unit 35, it is possible to hold the rotation of the motor 15 being stopped.

Moreover, the press machine 1 includes an integral fixing unit 37 between the small-diameter cylinder 7 and the small-diameter piston rod 7R to detect relative movements of the small-diameter piston 7P and the small-diameter piston rod 7R to the small-diameter cylinder 7 and to integrally fix the small-diameter cylinder 7 to the small-diameter piston rod 7R.

More specifically, a ball nut 41 in a ball screw mechanism is integrally attached to a bracket 39 integrally provided in the small-diameter cylinder 7, and a ball screw 43 in parallel to the small-diameter piston rod 7R is relatively and rotationally engaged into (mated into) tins ball nut 41. One end of the ball screw 43 is rotatably supported by a bracket 45 attached integrally to the small-diameter piston rod 7R.

A position detection unit 47 such as a rotary encoder and a fixing unit 49 such as a brake, both of which are rotatably supported by the bracket 45, are interlocked with and connected to the ball screw 43 via a power transmission mechanism 51 configured to put up a timing belt around a large-diameter pulley attached to one end of the ball screw 43 and a small-diameter pulley provided integrally with the position detection unit 47 and the fixing unit 49.

Since whether to provide the ball nut 41 on the bracket 39 or 45 is a relative decision, the configuration of the integral fixing unit 37 can be turned upside down so that the ball nut 41 is provided on the bracket 45 and so that the position detection unit 47 and the fixing unit 49 are provided on the bracket 39.

With the above-described configuration, if the small-diameter piston rod 7R is moved relatively to the small-diameter cylinder 7, the ball screw 43 is moved vertically and relatively to the ball nut 41 while being rotating. Accordingly, the position detection unit 47 rotates in an interlocked manner with the rotation of the ball screw 43 and detects the rotation of the ball screw 43. It is, therefore, possible to detect a moving distance and a moving position of the small-diameter piston rod 7R relative to the small-diameter cylinder 7 as well as a moving velocity at that time.

In a state in which the fixing unit 49 fixes the ball screw 43 not to rotate, the small-diameter cylinder 7 is integrated with the small-diameter piston rod 7R. By keeping the ball screw 43 locked by the fixing unit 49 and keeping the on-off valve 13 open, the motor 15 rotates the ball screw 23 and the slider (ram) 3 can be thereby mechanically moved.

As already understood, if the slider is moved by rotation of the motor 15, the rotational position detection unit 33 rotated in an interlocked manner with the motor 15 can detect the moving position of the slider 3 from the reference position and the moving velocity at that time. Further, if the small-diameter piston rod 7R is moved relatively to the small-diameter cylinder 7 while the rotation of the motor 15 is stopped, the position detection unit 47 provided on the integral fixing unit 37 can detect the relative moving position of the small-diameter piston rod 7R from a relative reference position (e.g., a position at which the small-diameter piston 7P is located on a stroke end on one end of the small-diameter cylinder 7) at which the small-diameter cylinder 7 and the small-diameter piston rod 7R are located relatively to each other as well as the moving velocity of the small-diameter piston rod 7R at that time.

Therefore, the moving position of the slider 3 from the reference position and the moving velocity thereof at that time can be detected based on a detected value of the rotational position detection unit 33 and that of the position detection unit 47. Due to this, even if the integral fixing unit 37 integrates the small-diameter cylinder 7 with the small-diameter piston rod 7R and the motor 15 rotates the ball screw 23 to move the slider 3 while the small-diameter piston rod 7R is appropriately moved relatively to the small-diameter cylinder 7, it is possible to always detect the position of the slider 3 accurately.

In the meantime, with the above-described configuration, it is necessary to raise an internal pressure of the second compartment 5B of the large-diameter cylinder 5 to a desired pressure to move the slider (ram) 3 as described above and to pressurize a pressurization target member (not shown), e.g., workpiece, to be pressurized. In this case, when the first compartments 5A and 7A and the second compartment 5B and 7B of the large-diameter cylinder 5 and the small-diameter cylinder 7 are simply filled with the working fluid such as oil, the internal pressure is raised from almost zero to the desired pressure, which takes lots of time to raise the pressure.

In the present embodiment, therefore, the working fluid filled up into a fluid pressure circuit including the first compartments 5A and 7A and the second compartments 5B and 7B of the large-diameter cylinder 5 and the small-diameter cylinder 7 is pressurized to a predetermined pressure equal to or higher than atmospheric pressure. The fluid pressure circuit includes a pressure application unit 53 that applies the pressure equal to or higher than the atmospheric pressure to the working fluid in the fluid pressure circuit in advance.

More specifically, the pressure application unit 53 is connected to an appropriate position of the fluid pressure circuit including the first compartments 5A and 7A and the second compartments 5B and 7B of the large-diameter cylinder 5 and the small-diameter cylinder 7, according to this embodiment to facilitate understanding, to the first compartment 5A of the large-diameter cylinder 5. The pressure application unit 53 includes a booster 55. The booster 55 includes a large-diameter air cylinder 61 connected to an air source 59 via a circuit switch valve 57 constituted by a solenoid valve or the like. A small-diameter piston rod 63R reciprocably fitted into a small-diameter hydraulic cylinder 63 is integrally connected to a reciprocable piston rod 61R reciprocated by causing the circuit switch valve 57 to switch over an air inflow direction in this air cylinder 61.

Therefore, if the piston rod 61R of the air cylinder 61 is actuated to protrude to press the small-diameter piston rod 63R into the hydraulic cylinder 63, the pressure oil in a pressure oil compartment 63A in the hydraulic cylinder 63 is pressurized and discharged. Since a configuration of the booster 53 of this type is well known, it will not be described in more detail.

The pressure oil compartment 63A of the hydraulic cylinder 63 is connected to the first compartment 5A of the large-diameter cylinder 5 via a connection path 65, and a check valve 67 allowing a flow of the pressure oil (working fluid) only from the pressure oil compartment 63A toward the first compartment 5A is arranged on this connection path 65. A first accumulator cylinder 71 which is connected to the air source 59 and to which a certain back pressure is applied is connected to a branch path 69 branched from and connected to the connection path 65 between the check valve 67 and the first compartment 5A.

Furthermore, a bypass path 77 connecting a relief valve 73 and a check valve 75 in series is connected to the check valve 67 in parallel. A second accumulator cylinder 81 which is connected to the air source 59 and to which a back pressure is applied is connected to a branch path 79 branched and connected between the relief valve 73 and the check valve 75.

With the above-described configuration, if connection of the circuit switch valve 57 is switched, air is supplied to the air source 61, and the piston rod 61R is actuated to protrude while the on-off valves 13, 21A, and 31A are kept open and the first compartment 5A and the second compartment 5B of the large-diameter cylinder 5 and the first compartment 7A and the second compartment 7B of the small-diameter cylinder 7 communicate with one another, the pressure oil in the pressure oil compartment 63A of the hydraulic cylinder 63 is pressurized and discharged by the piston rod 63R.

Accordingly, the pressurized working fluid is supplied to the first compartment 5A of the large-diameter cylinder 5 via the connection path 65, and an internal pressure of the fluid pressure circuit including the first compartment 5A and the second compartment 5B of the large-diameter cylinder 5 and the first compartment 7A and the second compartment 7B of the small-diameter cylinder 7 is pressurized to a predetermined pressure higher than the atmospheric pressure. If the circuit switch valve 57 is switched to return the piston rod 61R of the air cylinder 61 to an initial position, then the piston rod 63R in the hydraulic cylinder 63 is also returned to an original position, and the working fluid is supplied from the second accumulator cylinder 81 into the pressure oil compartment 63A of the hydraulic cylinder 63 and filled it up.

As described above, in FIG. 6, if the motor 15 rotates the ball screw 23 to move the small-diameter cylinder 7, the large-diameter cylinder 5, and the slider 3 downward to keep the on-off valves 13 and 21A open and to integrate the small-diameter cylinder 7 with the small-diameter piston rod 7R by the integral fixing unit 37 or to move the slider 3 downward by its own weight, the working fluid in the first compartment 5A of the large-diameter cylinder 5 flows into the second compartment 5B via the connection path 11 and the on-off valve 13.

Figure 7:
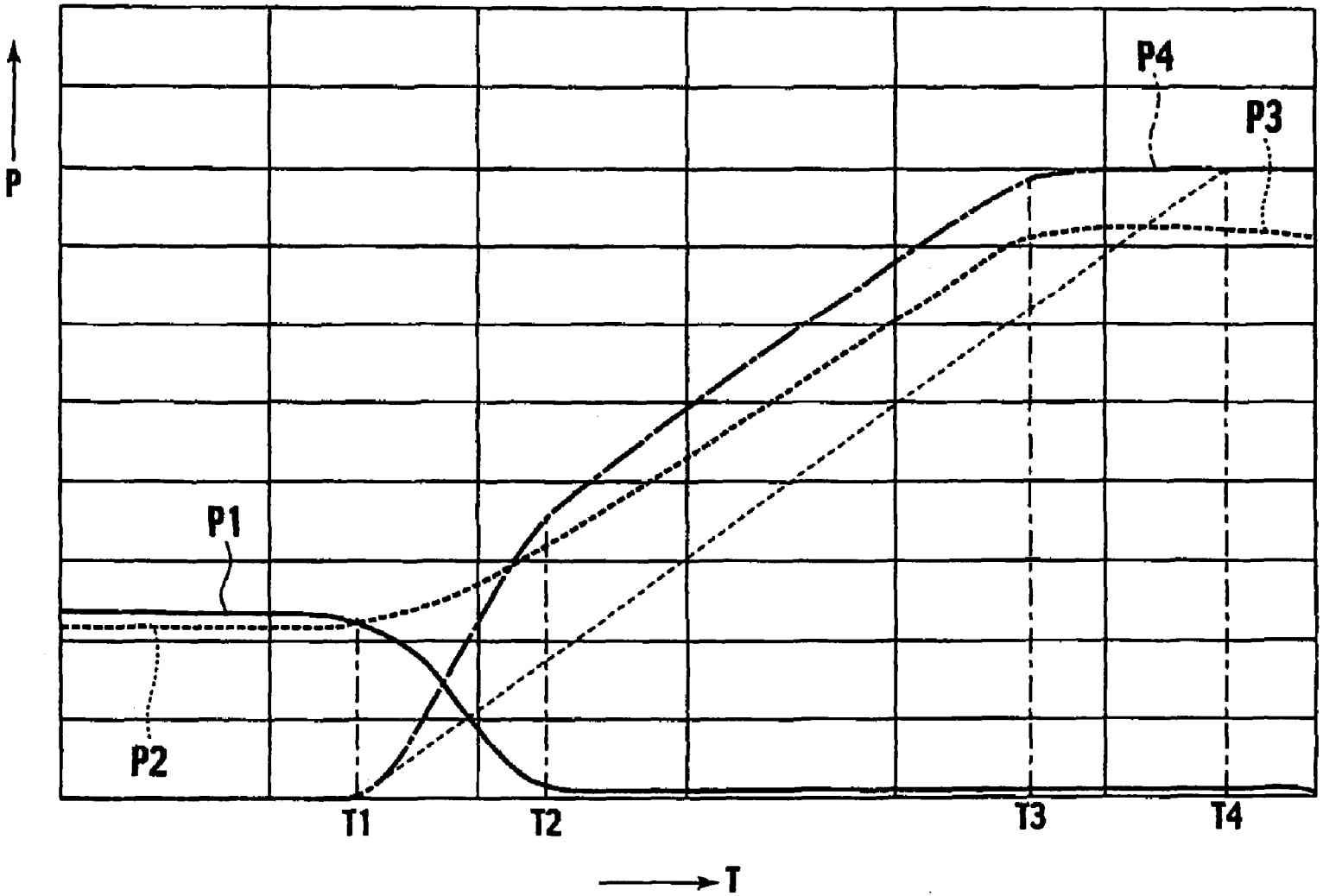
FIG. 7 is an explanatory graph showing a pressure change in a first compartment and a second compartment of a large-diameter cylinder.

Thereafter, if the on-off valve 13 is switched to a closed state when the slider 3 is moved downward to an appropriate position, then the working fluid in the second compartment 7B of the small-diameter cylinder 7 flows into the large-diameter cylinder 5B and the working fluid in the first compartment 5A of the large-diameter cylinder 5 flows into the first compartment 7A of the small-diameter cylinder 7 from the time of this switchover. At this time, as shown in FIG. 6, when the large-diameter cylinder 5 is raised relatively to the large-diameter piston rod 5R, it means the large-diameter cylinder 5 is relatively moved upward by making the internal pressure of die first compartment 5A of the large-diameter cylinder 5 slightly higher than that of the second compartment 5B. Due to this, as shown in a left side of FIG. 7 (in which a vertical axis indicates pressure P and a horizontal axis indicates a time T), an internal pressure P1 of the first compartment 5A is held slightly higher than an internal pressure P2 of the second compartment 5B. Thereafter, from the time when the slider 3 abuts on a pressurization target (a time T1 shown in FIG. 7), the internal pressure of the second compartment 5B gradually rises, and the internal pressure of the first compartment 5A gradually falls to be almost close to the atmospheric pressure.

Thereafter, if the internal pressure of the second compartment 5B of the large-diameter cylinder 5 rises to a desired pressure P3 by causing the slider 3 to pressurize the pressurization target, a desired pressurization force P4 (P4=((Internal pressure of the second compartment 5B−Internal pressure of first compartment 5A)×Area) for pressurizing the pressurization target is obtained. The pressurization force is almost zero by the time T1 when the on-off valve 13 is actuated to be closed, rapidly rises from the time T1 to a time T2 when the internal pressure of the first compartment 5A nears the atmospheric pressure, and proportionally rises from the time T2 to the time T3 when the desired pressure P3 is obtained.

Meanwhile, the internal pressure of the second compartment 5B of the large-diameter cylinder 5 is initially P2 equal to or higher than the atmospheric pressure and proportionally rises from the pressure P2 to the pressure P3. Due to this, the time is shortened by as much as (T4−T3) as compared with a period during which the pressure proportionally rises from a pressure 0 at the time T1 to the pressure P3 at the time T4. Therefore, it is possible to shorten the time for raising the pressure to the pressure P3 for obtaining the desired pressure P4 and to improve operation efficiency.

If the internal pressure of the first compartment 5A of the large-diameter cylinder 5 is higher than the back pressure acting on the first accumulator cylinder 71, the working fluid flows into the first accumulator cylinder 71. If the internal pressure of the first compartment 5A is equal to or higher than a predetermined pressure, the working fluid flows into the second accumulator cylinder 81 via the relief valve 73. Accordingly, the accumulator cylinders 71 and 81 absorb a pulsatory motion generated when the large-diameter cylinder 5 is vertically moved relatively to the large-diameter piston 5P, thus censuring the smooth operation of the large-diameter cylinder 5.

Note that the present invention is not limited only to the configurations described above but that the present invention can be also applied for various machines and apparatuses, e.g., filter press, configured so that a pressurization member that is one example of a slider reciprocates horizontally.

Entire contents of Japanese Patent Applications No. 2005-162687 (filed on Jun. 2, 2005), No. 2005-337717 (filed on Nov. 22, 2005), No. 2006-127475 (filed on May 1, 2006), and No. 2006-127477 (filed on May 1, 2006) are included in the descriptions of the present application by reference.

The embodiments of the present invention described above are to be considered not restrictive, and the invention can be embodied in other various forms, as changes are appropriately made.

The invention claimed is:

1. A ram driving apparatus driving a ram reciprocated by a fluid pressure mechanism, wherein a large-diameter cylinder attached integrally to the ram is divided into a first compartment and a second compartment by a large-diameter piston relatively reciprocably included in the large-diameter cylinder, and one end of a large-diameter piston rod protruding from the large-diameter cylinder integrally with the large-diameter piston is fixed to a fixing unit, a small-diameter cylinder integral with the large-diameter cylinder is divided into a first compartment and a second compartment by a small-diameter piston relatively reciprocably included in the small-diameter cylinder, and one end of a small-diameter piston rod protruding from the small-diameter cylinder integrally with the small-diameter piston is connected to a moving member moved by a motor driving, and the first compartment of the large-diameter cylinder is connected to the first compartment of the small-diameter cylinder via a connection path, and the second compartment of the large-diameter cylinder is connected to the second compartment of the small-diameter cylinder via a connection path, and internal pressures of the first compartment and the second compartment of each of the large-diameter cylinder and the small-diameter cylinder are pressurized to a predetermined pressure equal to or higher than an atmospheric pressure.

2. The ram driving apparatus according to claim 1, comprising a pressure application unit that applies a pressure equal to or higher than the atmospheric pressure into a fluid pressure circuit of each of the large-diameter cylinder and the small-diameter cylinder.

3. The ram driving apparatus according to claim 1, comprising an integral fixing unit capable of integrating the small-diameter cylinder with the small-diameter piston rod.

4. The ram driving apparatus according to claim 2, comprising an integral fixing unit capable of integrating the small-diameter cylinder with the small-diameter piston rod.

5. The ram driving apparatus according to claim 3, wherein the integral fixing unit includes a position detection unit that detects relative moving positions of the small-diameter cylinder and the small-diameter piston rod to each other.

6. The ram driving apparatus according to claim 4, wherein the integral fixing unit includes a position detection unit detects relative moving positions of the small-diameter cylinder and the small-diameter piston rod to each other.

7. A ram position detection method for a ram driving apparatus configured so that first compartments and second compartments of a large-diameter cylinder and a small-diameter cylinder provided integrally with a ram reciprocably included in a frame are connected to each other respectively, comprising the steps of:

detecting a moving position of the small-diameter cylinder relative to the frame, and relative moving positions of the small-diameter piston rod included in the small-diameter cylinder and the small-diameter cylinder to each other; and detecting a moving position of the ram relative to the frame based on detected values by the both detections.

8. A ram driving apparatus configured so that first compartments and second compartments of a large-diameter cylinder and a small-diameter cylinder provided integrally with a ram reciprocably included in a frame are connected to each other respectively, comprising:

a first position detection unit that detects a moving position of the small-diameter cylinder relative to the frame; and a second position detection unit that detects relative moving positions of a small-diameter piston rod included in the small-diameter cylinder and the small-diameter cylinder to each other.

9. The ram driving apparatus according to claim 8, wherein the second position detection unit includes a rotational operation mechanism rotationally operating during a movement of the small-diameter piston rod relative to the small-diameter cylinder, and is configured to detect a rotation of the rotational operation mechanism.

* * * * *